US010981175B2

(12) United States Patent
Brader et al.

(10) Patent No.: US 10,981,175 B2
(45) Date of Patent: Apr. 20, 2021

(54) SEGMENTED BOWL LINER WITH REUSABLE SUPPORT CASSETTE

(71) Applicant: Metso Minerals Industries, Inc., Waukesha, WI (US)

(72) Inventors: Timothy David Brader, West Bend, WI (US); Mikko Kalevi Malkamäki, Vantaa (FI)

(73) Assignee: Metso Minerals Industries, Inc., Waukesha, WI (US)

( * ) Notice: Subject to any disclaimer, the term of this patent is extended or adjusted under 35 U.S.C. 154(b) by 140 days.

(21) Appl. No.: 16/180,217

(22) Filed: Nov. 5, 2018

(65) Prior Publication Data

US 2020/0139377 A1 May 7, 2020

(51) Int. Cl.
*B02C 2/00* (2006.01)
*B02C 2/04* (2006.01)

(52) U.S. Cl.
CPC ..... *B02C 2/005* (2013.01); *B02C 2/04* (2013.01)

(58) Field of Classification Search
CPC ..... B02C 2/005; B02C 2/04; B02C 2/10
See application file for complete search history.

(56) References Cited

U.S. PATENT DOCUMENTS 2,594,080 A 4/1952 Shafter
2,989,253 A 6/1961 MacLeod
3,682,227 A 8/1972 Motz et al.
3,834,633 A 9/1974 Dougall et al.
4,065,064 A 12/1977 Anthony
4,756,484 A 7/1988 Bechler et al.
4,886,218 A 12/1989 Bradley et al.
5,080,294 A 1/1992 Dean
5,597,628 A 1/1997 Cetrelli et al.
5,638,890 A * 6/1997 Didion ..... B22D 31/007 164/131
6,595,267 B2 * 7/2003 Didion ..... B22D 31/007 164/269
7,357,824 B2 4/2008 Hakola
7,451,944 B2 11/2008 Hall et al.
8,387,905 B2 * 3/2013 Solomon ..... B02C 2/005 241/207

(Continued)

OTHER PUBLICATIONS

International Search Report and Written Opinion for International Application No. PCT/US2019/059630 dated May 12, 2020.

*Primary Examiner* — Faye Francis
(74) *Attorney, Agent, or Firm* — Andrus Intellectual Property Law, LLP

(57) ABSTRACT

A bowl liner for use in a crusher that is comprised of a support cassette and a plurality of bowl liner sections mounted to the support cassette. Each of the bowl liner sections is mounted along an inner surface of the support cassette. Once the bowl liner sections are positioned along the inner surface of the support cassette, a plurality of support plates are used to support the bowl liner sections on the support cassette. An epoxy material can be utilized to further attach the plurality of bowl liner sections to the support cassette such that the bowl liner sections are held securely in place during use. The bowl liner can be replaced in the crusher as a single unit. After use, the bowl liner sections can be removed from the support cassette and the support cassette can be reused with another set of bowl liner sections.

13 Claims, 9 Drawing Sheets

(56) References Cited

U.S. PATENT DOCUMENTS

| | | | | |
|---|---|---|---|---|
| 9,399,221 | B2 | 7/2016 | Biggin | |
| 9,962,708 | B2 | 5/2018 | Papajewski | |
| 10,179,335 | B2 * | 1/2019 | Malmqvist | B02C 2/005 |
| 2001/0045476 | A1 | 11/2001 | Washburn et al. | |
| 2002/0023729 | A1 * | 2/2002 | Didion | B22D 31/007 164/269 |
| 2008/0041995 | A1 | 2/2008 | Hall et al. | |
| 2014/0158801 | A1 | 6/2014 | Euculano et al. | |
| 2015/0283549 | A1 * | 10/2015 | Malmqvist | B02C 17/22 241/207 |
| 2015/0314300 | A1 * | 11/2015 | Malmqvist | B02C 2/007 241/285.2 |
| 2016/0288128 | A1 | 10/2016 | Loke et al. | |

* cited by examiner

SEGMENTED BOWL LINER WITH REUSABLE SUPPORT CASSETTE

BACKGROUND

The present disclosure generally relates to rock crushing equipment. More specifically, the present disclosure relates to a crusher that includes a wear liner having a reusable support cassette that supports a plurality of wear elements, such as bowl liner sections or concaves.

Rock crushing systems, such as those referred to as cone crushers or gyratory crushers, generally break apart rock, stone or other material in a crushing gap between a stationary element and a moving element. For example, a conical rock crusher is comprised of a head assembly including a crushing head that gyrates about a vertical axis within a stationary bowl indirectly attached to a main frame of the rock crusher. The crushing head is assembled surrounding an eccentric that rotates about a fixed shaft to impart the gyrational motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The exterior of the conical crushing head is covered with a protective or wear-resistant mantle that engages the material that is being crushed, such as rock, stone, ore, minerals or other substances. The bowl, which is indirectly mechanically fixed to the mainframe, is fitted with a bowl liner or, in the case of a gyratory crusher, a series of concaves. The bowl liner and bowl are stationary and spaced from the crushing head. The bowl liner provides an opposing surface from the mantle for crushing the material. The material is crushed in the crushing gap between the mantle and the bowl liner.

The gyrational motion of the crushing head with respect to the stationary bowl crushes, rock, stone or other material within the crushing gap. Generally, the rock, stone or other material is fed onto a feed plate that directs the material toward the crushing gap where the material is crushed as it travels through the crushing gap. The crushed material exits the crushing chamber through the bottom of the crushing gap. The size of the crushing gap determines the maximum size of the crushed material that exits the crushing gap.

As the cone crusher operates, the outer wear surface of the bowl liner begins to deteriorate such that the space between the crushing surfaces increases, which reduces the crusher's ability to produce the desired geometry of material leaving the crusher. As the bowl liner continues to wear, the bowl liner reaches a point where it must be removed from the cone crusher. Typically, the bowl liner is formed from austenitic manganese steel that, after being removed, is scraped and a new bowl liner is installed in the cone crusher. During the replacement process, the bowl liner is installed in the cone crusher on location, which can often result in misalignment or difficulty in placing the bowl liner in the required location in the cone crusher.

SUMMARY

The present disclosure relates to a multi-section bowl liner for use in rock crushing equipment, such as a cone crusher. More specifically, the present disclosure relates to a bowl liner that includes a cassette and a plurality of bowl liner sections supported along the cassette.

In an exemplary embodiment, the bowl liner of the present disclosure is designed for use in a cone crusher. The bowl liner is formed as an assembled structure that includes a support cassette. The support cassette has a generally conical inner surface and a lower attachment rim. A plurality of bowl liner sections are supported along the inner surface of the support cassette. Each of the bowl liner sections includes an inner surface, an outer surface, a lower end and an upper end. When the bowl liner sections are supported along the inner surface of the support cassette, a plurality of support plates are attached to the lower rim of the support cassette such that the support plates hold the bowl liner sections along the inner surface of the support cassette. In an exemplary embodiment of the present disclosure, a plurality of support plates is associated with each of the bowl liner sections. The support plates are attached to the lower rim of the cassette, such as through the use of one or more connectors.

Each of the support plates can be selectively removed and attached to the lower rim to hold the bowl liner sections in place. The support plates include an inner support leg that contacts the bowl liner section and an outer support leg that contacts the lower rim of the cassette. The one or more connectors used to attach the support plates to the support cassette are received within internal bores formed in the lower rim of the cassette. In this manner, the support plates can be selectively removed and attached to the support cassette to allow for assembly and disassembly of the bowl liner sections from the support cassette.

The bowl liner of the present disclosure is designed for use with a cone crusher, although the bowl liner could be used with other types of crushing equipment, such as a gyratory crusher. The bowl liner is positioned on a stationary bowl and is spaced from a movable head. During operation, the head rotates relative to the stationary bowl liner such that material is crushed within a crushing gap of the cone crusher. After extended use, the bowl liner is removed and replaced from the cone crusher. In one exemplary embodiment, a second bowl liner is installed into the cone crusher, where the second bowl liner is pre-assembled prior to installation. In this manner, the bowl liner of the present disclosure can be assembled offsite and installed into the cone crusher as a single unit. In a contemplated alternate embodiment, once the bowl liner is removed, the individual bowl liner sections can be removed from the support cassette and new bowl liner sections installed. The refurbished bowl liner would then be installed into the cone crusher as a single unit.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
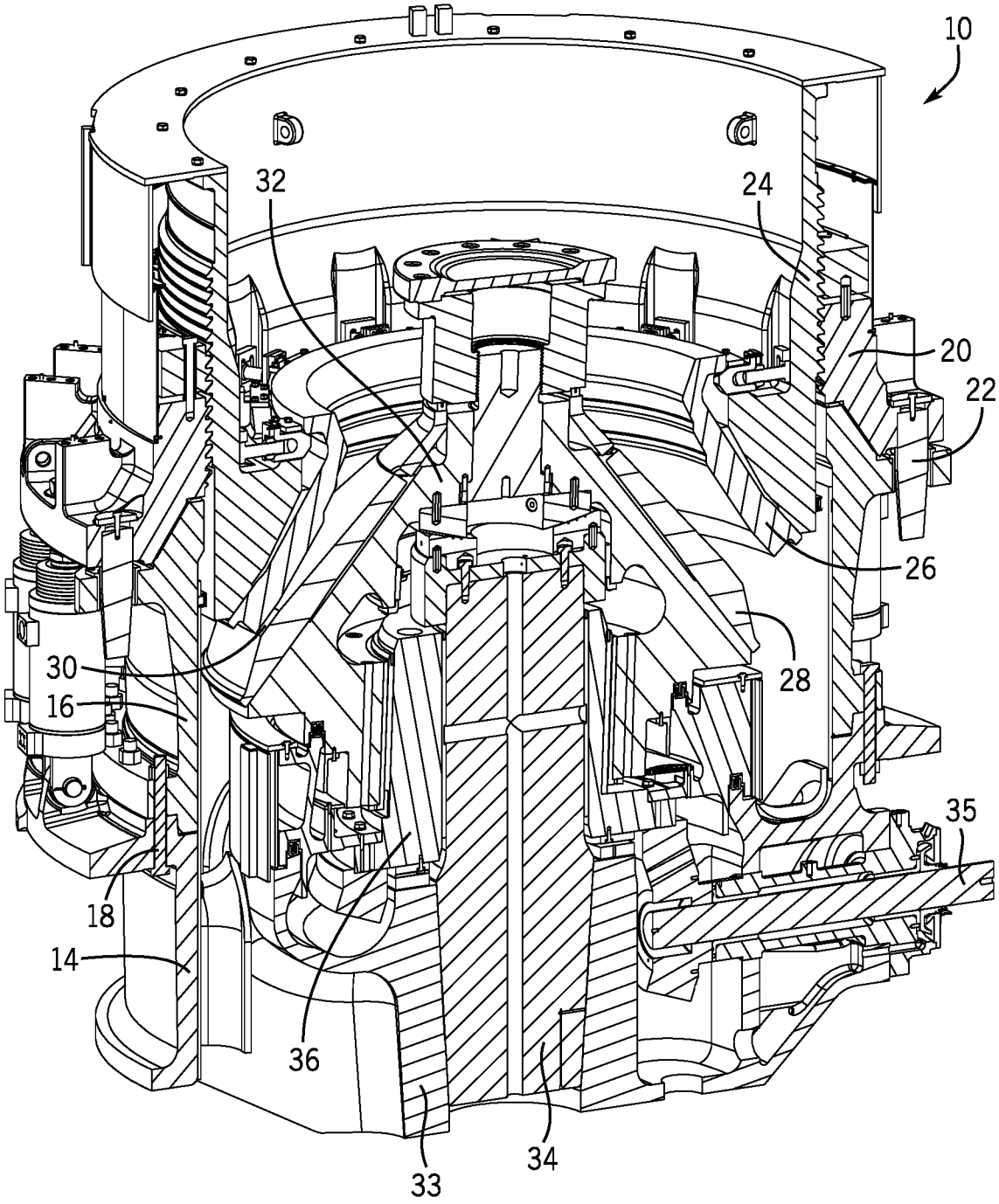
FIG. 1 (PRIOR ART)
FIG. 1 is a section view of a cone crusher incorporating the segmented bowl liner of the present disclosure.

FIG. 1 illustrates a gyrational crusher, such as a cone crusher 10, that is operable to crush material, such as rock, stone, ore, mineral or other substances. Although the present disclosure is shown with respect to a cone crusher, it is contemplated that the subject matter of the present disclosure could be incorporated into other types of crushers, such as a gyratory crusher. The cone crusher 10 shown in FIG. 1 is of sufficiently large size such that the mainframe is split into two separate pieces based upon both manufacturing and transportation limitations. The mainframe includes a lower mainframe 14 and an upper mainframe 16 that are joined to each other by a series of fasteners 18. The upper mainframe 16 receives and supports an adjustment ring 20. As illustrated in FIG. 1, a series of pins 22 are used to align the adjustment ring 20 relative to the upper mainframe 16 and prevent rotation therebetween.

The adjustment ring 20 receives and partially supports a bowl 24 which in turn supports a prior art one-piece bowl liner 26. The one-piece bowl liner 26 combines with a mantle 28 to define a crushing gap 30. Mantle 28 is mounted to a head assembly 32 that is supported on a main shaft 34. The main shaft 34, in turn, is connected to a mainframe hub 33 that is connected to the outer barrel (cylinder) of the mainframe. An eccentric 36 rotates about the stationary main shaft 34, thereby causing the head assembly 32 to gyrate within the cone crusher 10. Gyration of the head assembly 32 within the stationary bowl 24 supported by the adjustment ring 20 allows rock, stone, ore, minerals or other materials to be crushed between the mantle 28 and the bowl liner 26.

When the cone crusher 10 is operating, a driven counter shaft 35 rotates the eccentric 36. Since the outer diameter of the eccentric 36 is offset from the inner diameter, the rotation of the eccentric 36 creates the gyrational movement of the head assembly 32 within the stationary bowl 24. The gyrational movement of the head assembly 32 changes the size of the crushing gap 30 which allows the material to be crushed to enter into the crushing gap. Further rotation of the eccentric 36 creates the crushing force within the crushing gap 30 to reduce the size of particles being crushed by the cone crusher 10. The cone crusher 10 may be one of many different types of cone crushers available from various manufacturers, such as Metso Minerals of Waukesha, Wis. An example of the cone crusher 10 shown in FIG. 1 can be an MP® Series rock crusher, such as the MP 2500 available from Metso Minerals. However, different types of cone crushers could be utilized while operating within the scope of the present disclosure.

Figure 2:
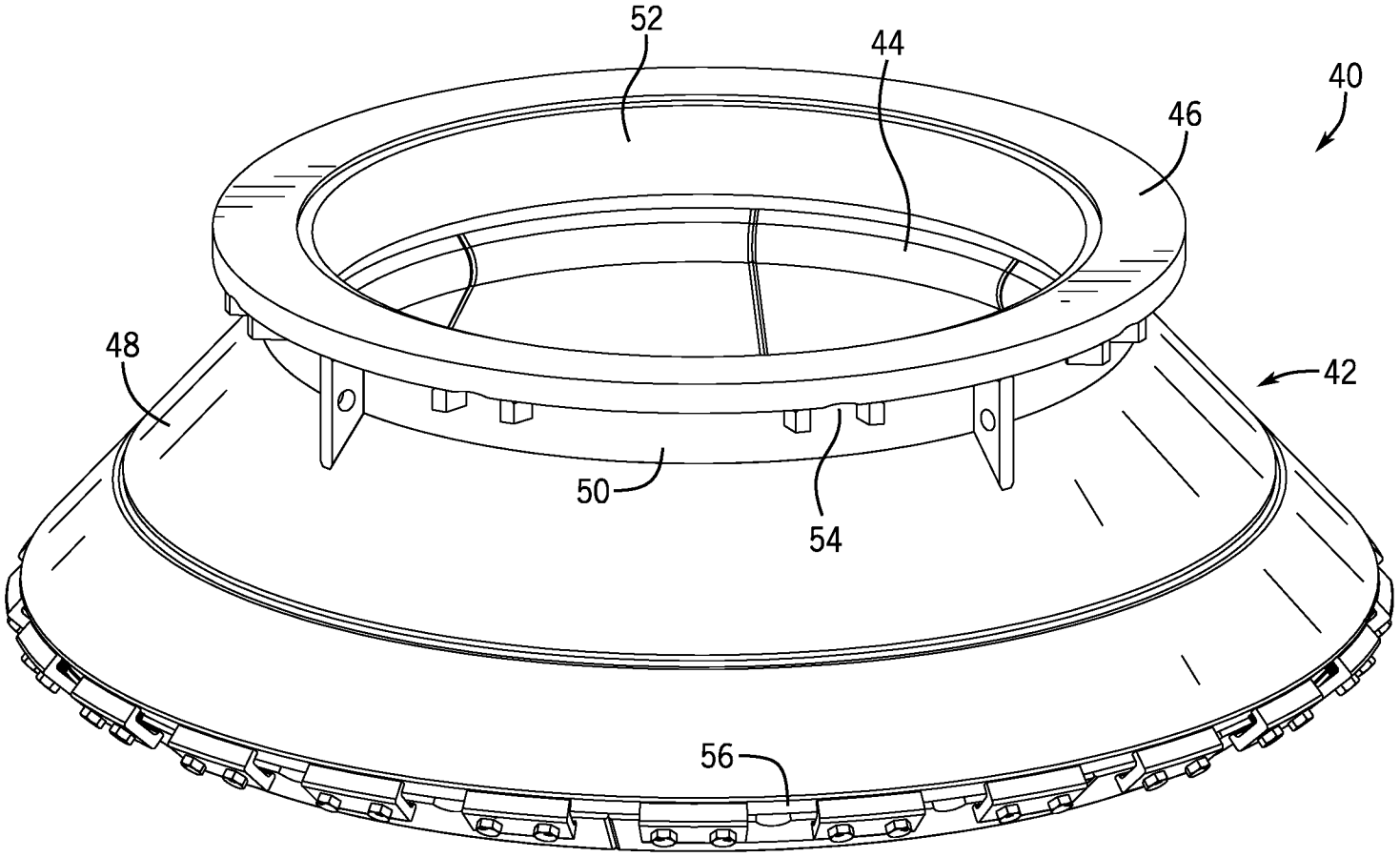
FIG. 2 is a perspective view illustrating the segmented bowl liner constructed in accordance with an exemplary embodiment of the present disclosure.

The embodiment shown in FIG. 1 illustrates a cone crusher 10 in which the bowl liner 26 is a single piece member formed from a metallic material, such as austenitic manganese steel. When the one-piece bowl liner 26 becomes worn, the bowl liner 26 is removed from the cone crusher and scrapped. A new bowl liner is installed while the cone crusher remains at the mining site. In accordance with the present disclosure, the one-piece bowl liner 26 shown in FIG. 1 is replaced by a redesigned and reusable bowl liner 40 that can be installed into the cone crusher 10 without any additional modifications to the cone crusher 10. The bowl liner 40 of the present disclosure is shown in FIG. 2. The bowl liner 40 includes a support cassette 42 and a plurality of bowl liner sections 44 mounted to and supported along the support cassette 42. The entire bowl liner 40 can be removed from the cone crusher in the same manner as the one-piece bowl liner 26 shown in FIG. 1. However, in the exemplary embodiment shown in FIG. 2, the bowl liner 40 includes the support cassette 42 and a series of removable and replaceable bowl liner sections 44. The entire bowl liner 40 can be assembled off site or on location and can be inserted into the cone crusher as a single unit in the same manner as the one-piece bowl liner 26 shown in FIG. 1.

The support cassette 42 is generally formed from a durable material, such as a hardened alloy steel, white iron or high chrome white iron. The support cassette 42 includes an upper attachment lip 46 that is joined to a frusto-conical body portion 48 by a generally vertical support wall 50. The support wall 50 defines an inner surface 52 that provides the point of entry for material into the crushing gap of the crusher between the stationary bowl liner 40 and the rotating mantle as previously described. The bowl liner 40 includes a series of attachment features 54 that allow the bowl liner 40 to be mounted within the cone crusher in the same manner as the prior art one-piece bowl liner 26 shown in FIG. 1.

Figure 3:
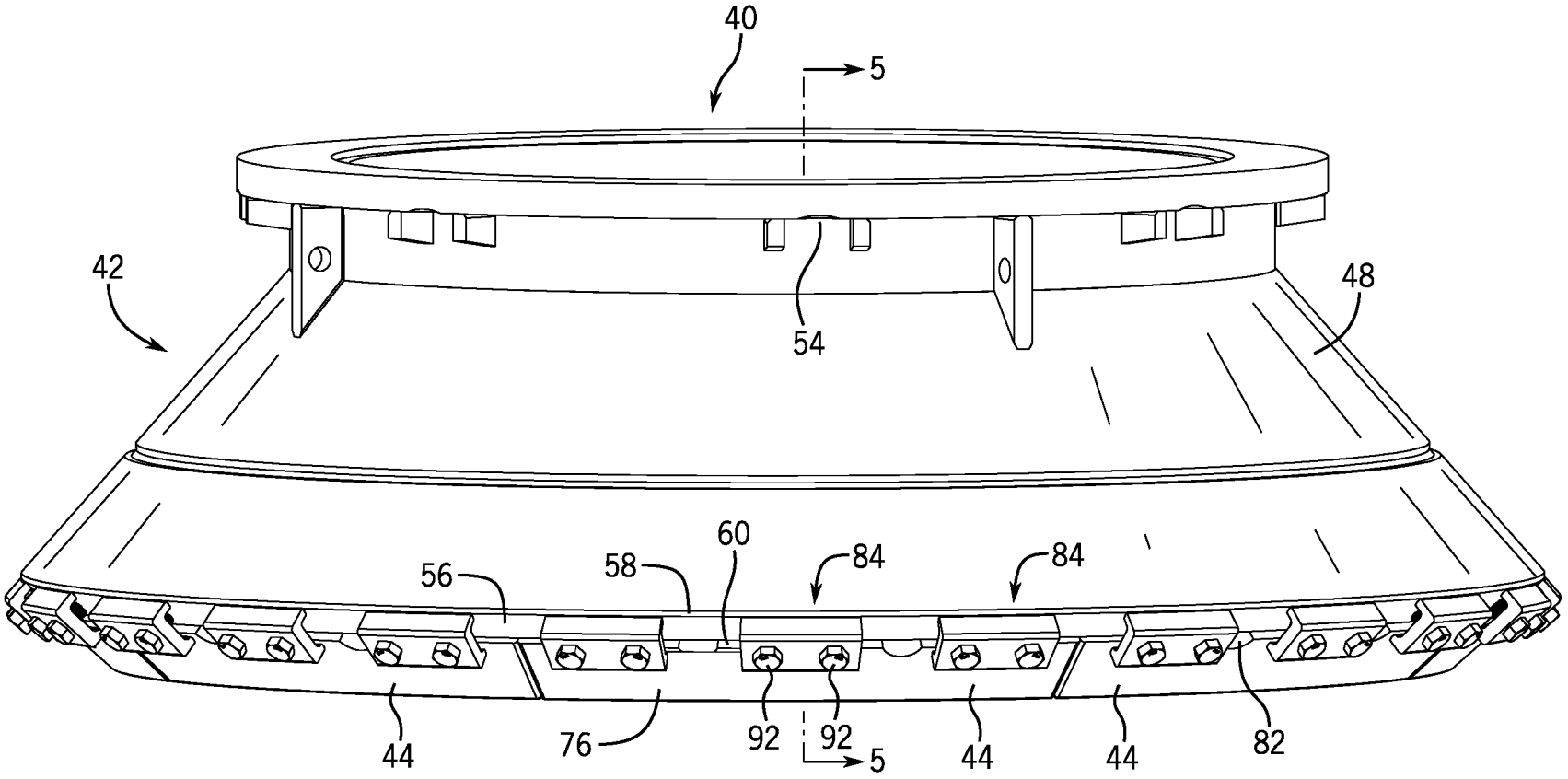
FIG. 3 is a side view of the segmented bowl liner of FIG. 2.

As can be seen in FIG. 3, the body portion 48 has a frusto-conical shape and terminates with a lower rim 56. The lower rim 56 has a thickness between an outer surface 58 and an inner surface 60 which define the thickness of the body portion 48. As can best be seen in the cross section view of FIG. 5, the inner surface 60 is generally frusto-conical and extends from an upper edge 62 to a lower edge 64. The lower edge 64 defines the inner portion of the lower rim 56. The inner surface 60 includes a pair of recessed internal channels 61 that extend around the inner surface and are spaced from each other.

Figure 4:
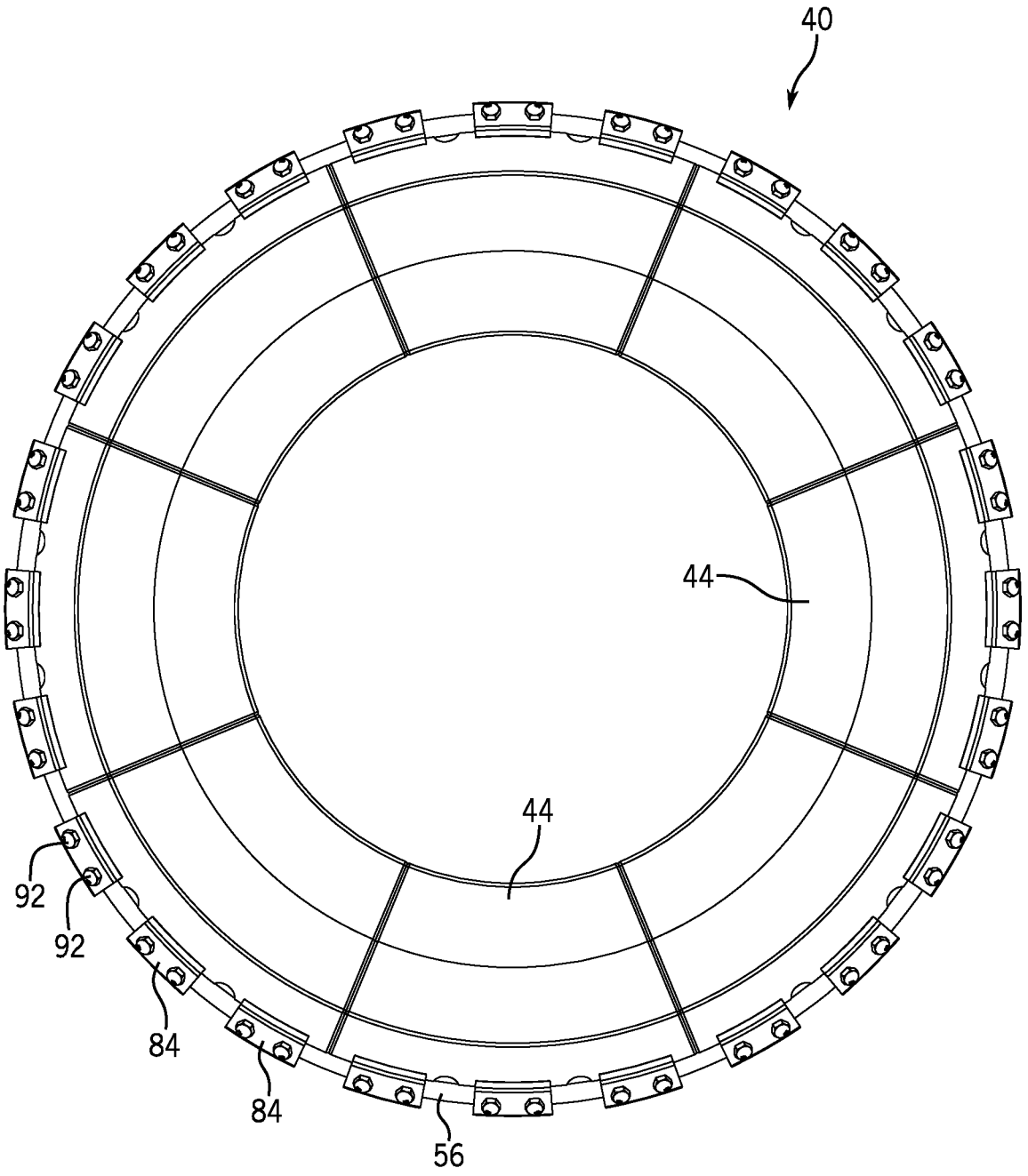
FIG. 4 is a bottom view of the segmented bowl liner.

As best seen in FIG. 4, the bowl liner 40 includes a plurality of individual bowl liner sections 44 that are each positioned adjacent to each other and are mounted to cover the entire frusto-conical inner surface of the support cassette. In the embodiment shown in FIG. 4, eight individual bowl liner sections are mounted to the inner surface of the support cassette although other numbers and sizes are contemplated.

Figure 5:
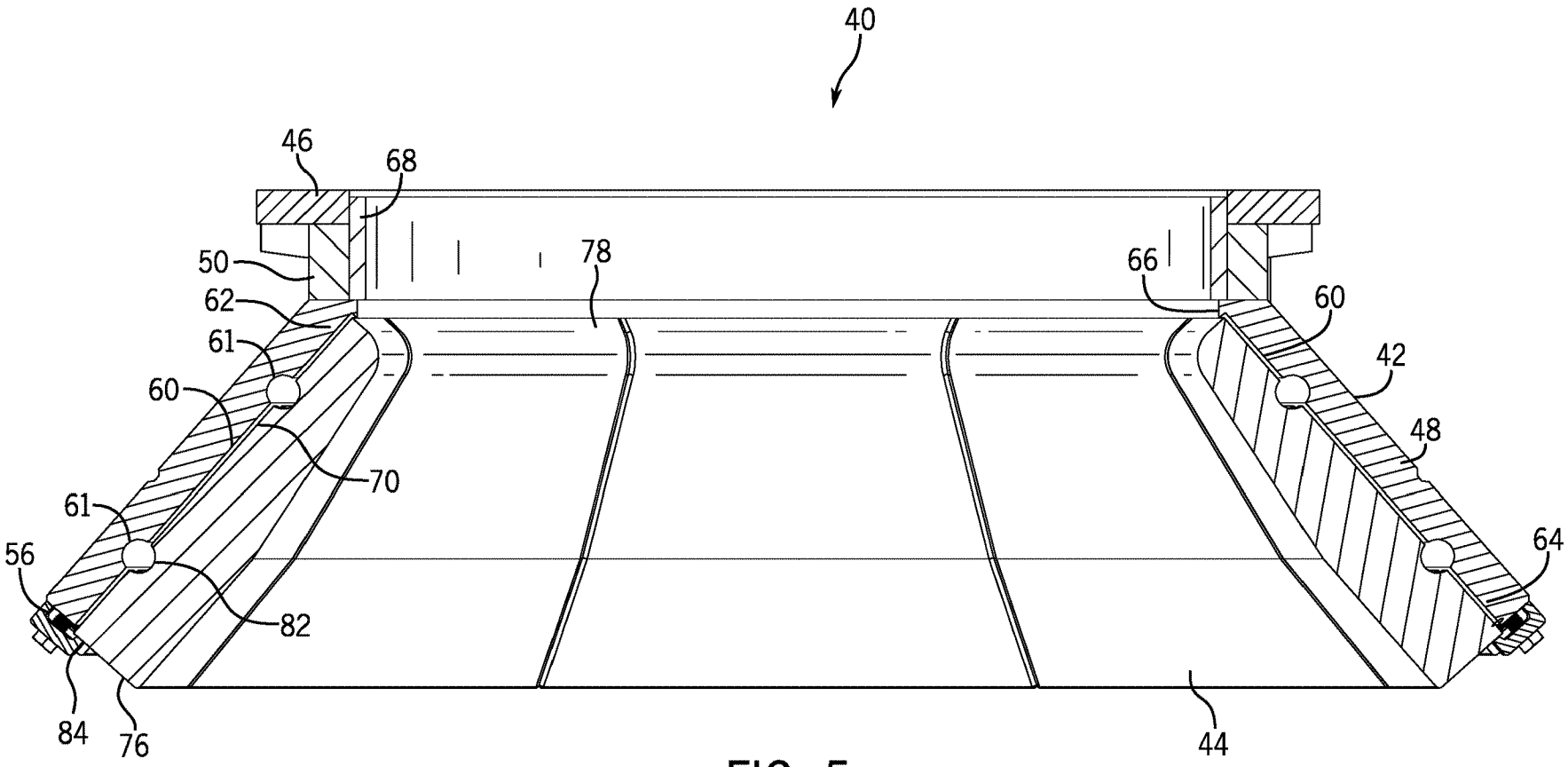
FIG. 5 is a section view taken along line 5-5 of FIG. 3.
Figure 6:
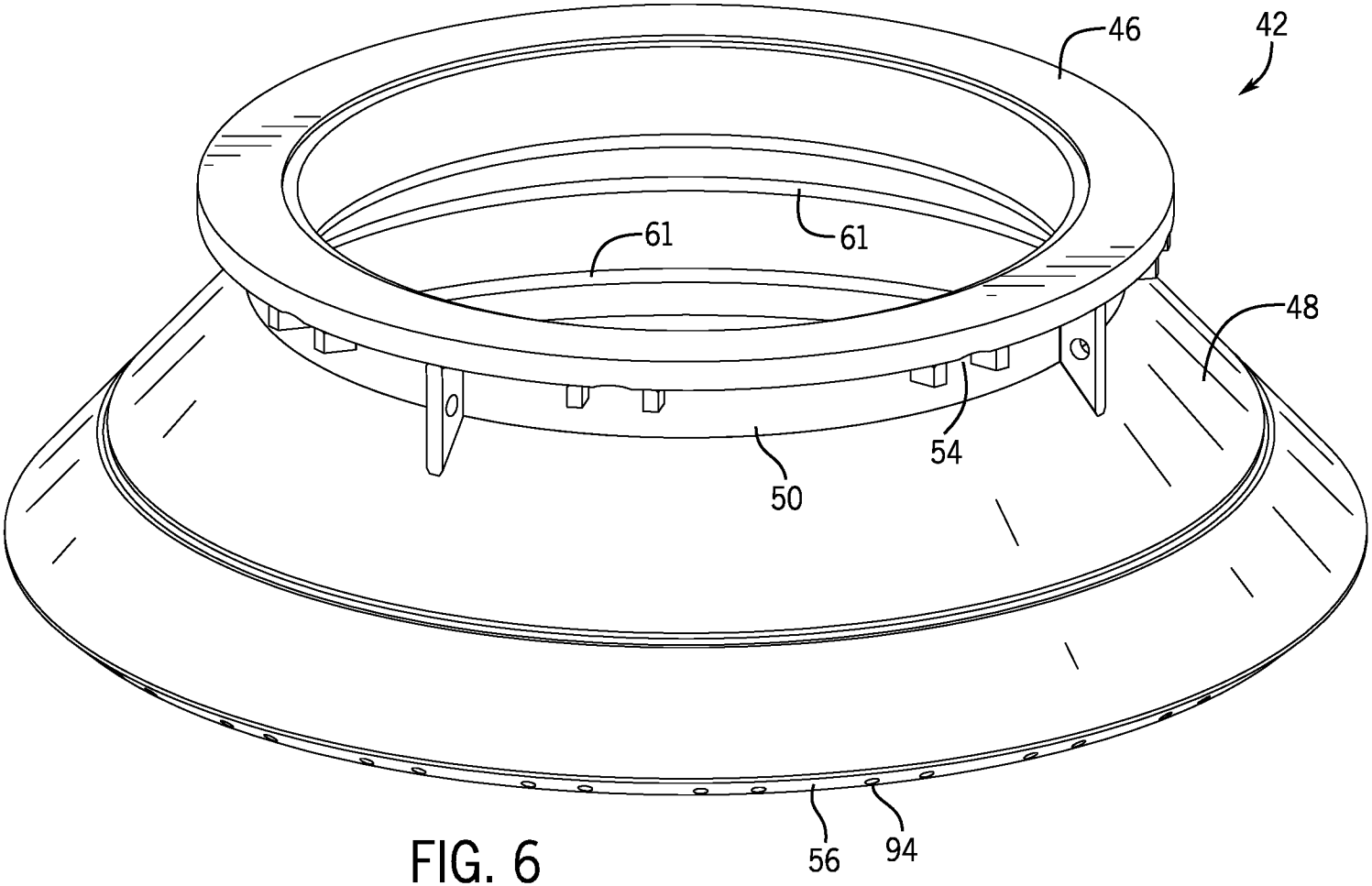
FIG. 6 is a perspective view of the reusable support cassette.

As best seen in FIG. 5, the inner surface 60 of the body portion 48 of the support cassette 42 terminates at a retaining lip 66 that extends past the otherwise smooth inner surface 60. The interaction between the retaining lip 66 and each of the individual bowl liner sections 44 will be discussed in greater detail below.

As can be seen in the embodiment of FIG. 5, a wear strip 68 is attached to the inner surface of the combination of the attachment lip 46 and the support wall 50. The wear strip 68 provides additional wear resistance for the attachment lip 46 and support wall 50 since material being crushed passes through this portion of the bowl liner 40 for crushing within the crushing gap.

Figure 8:
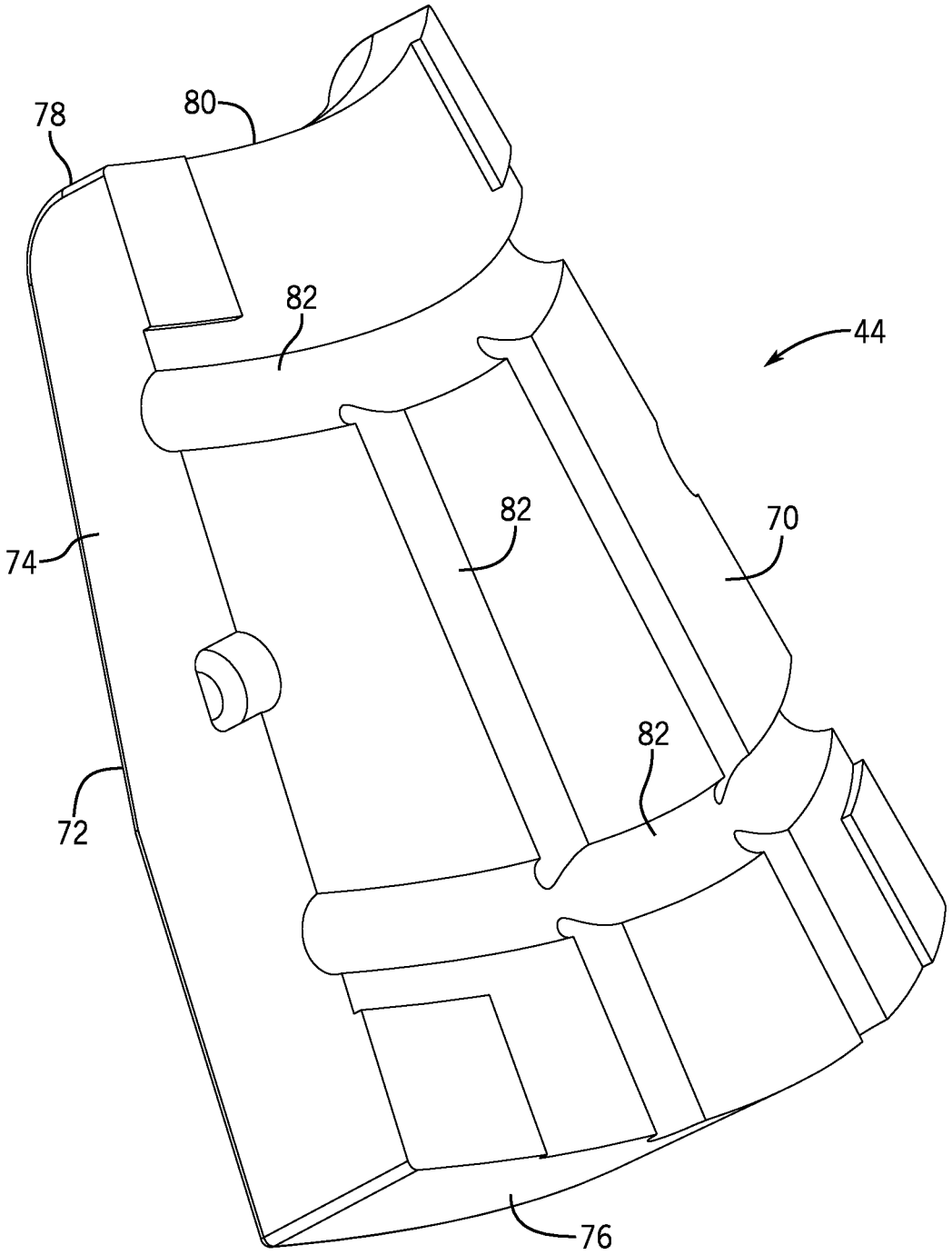
FIG. 8 is a perspective view of one of the bowl liner sections removed from the cassette.
Figure 9:
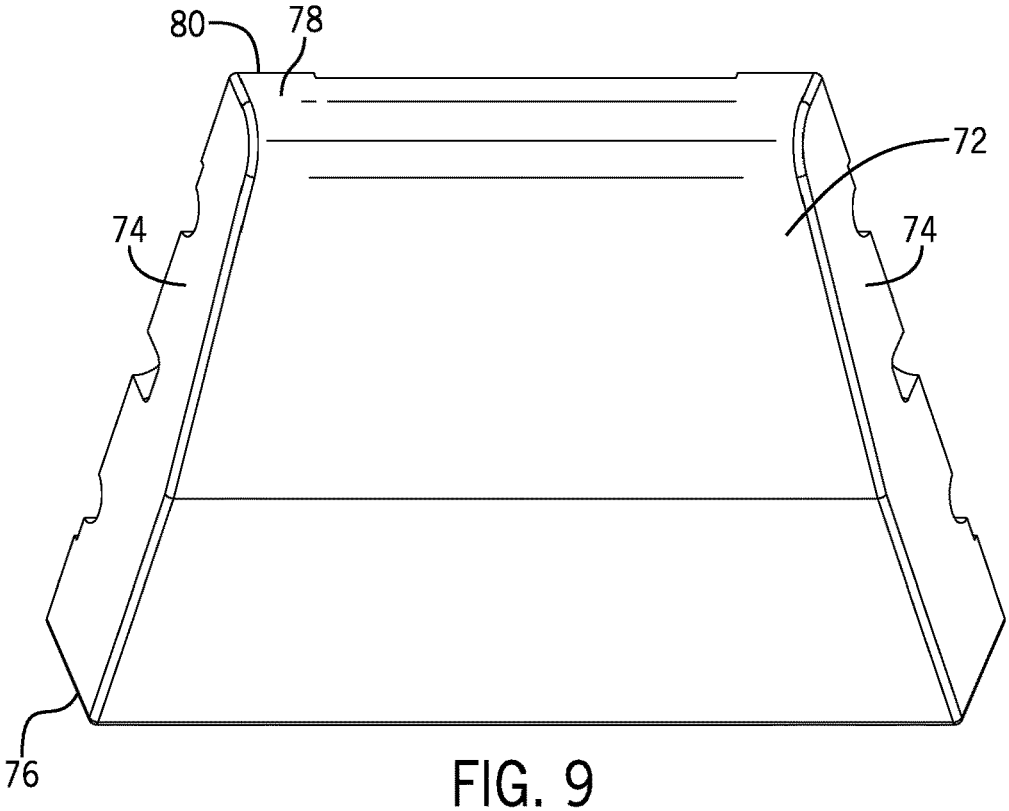
FIG. 9 is a view showing the wear surface of the bowl liner section.
Figure 10:
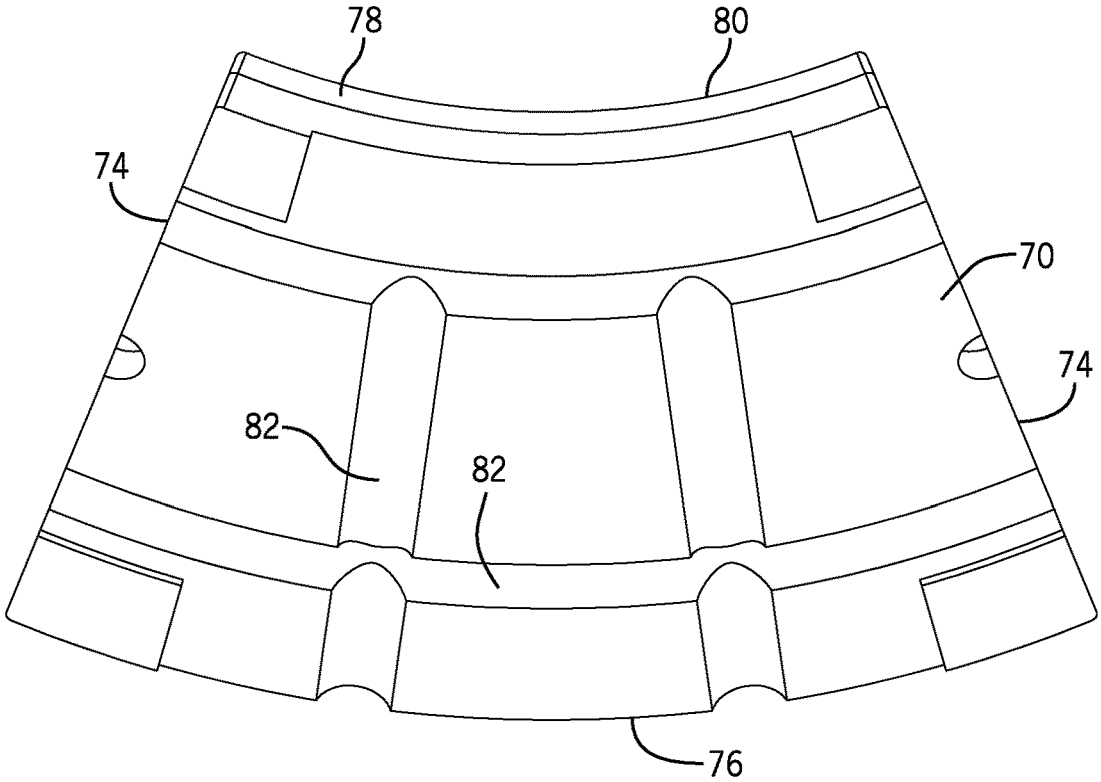
FIG. 10 is a view showing the mounting surface of the bowl liner section.

FIGS. 8-10 illustrate an exemplary embodiment of each of the bowl liner sections 44 constructed in accordance with the present disclosure. Each of the bowl liner sections 44 is formed from a wear resistant material, such as a hardened alloy steel. Each of the bowl liner sections 44 is designed to be subject to wear and, upon being worn, removed and replaced from the support cassette. Each of the bowl liner sections 44 includes mounting surface 70, a wear surface 72, a pair of side edges 74, a bottom surface 76 and a curved top surface 78, where the curved top surface terminates at a top edge 80. As can best be seen in FIGS. 8 and 10, the mounting surface 70 includes a series of interconnected recessed channels 82. The vertical channels 82 each extend to the bottom surface 76 and communicate with the horizontal channels 82. The interaction between the vertical and horizontal channels 82 allows epoxy to flow between the channels to attach the bowl liner sections 44 to the support cassette 42 in a manner as will be discussed in greater detail below.

Figure 7:
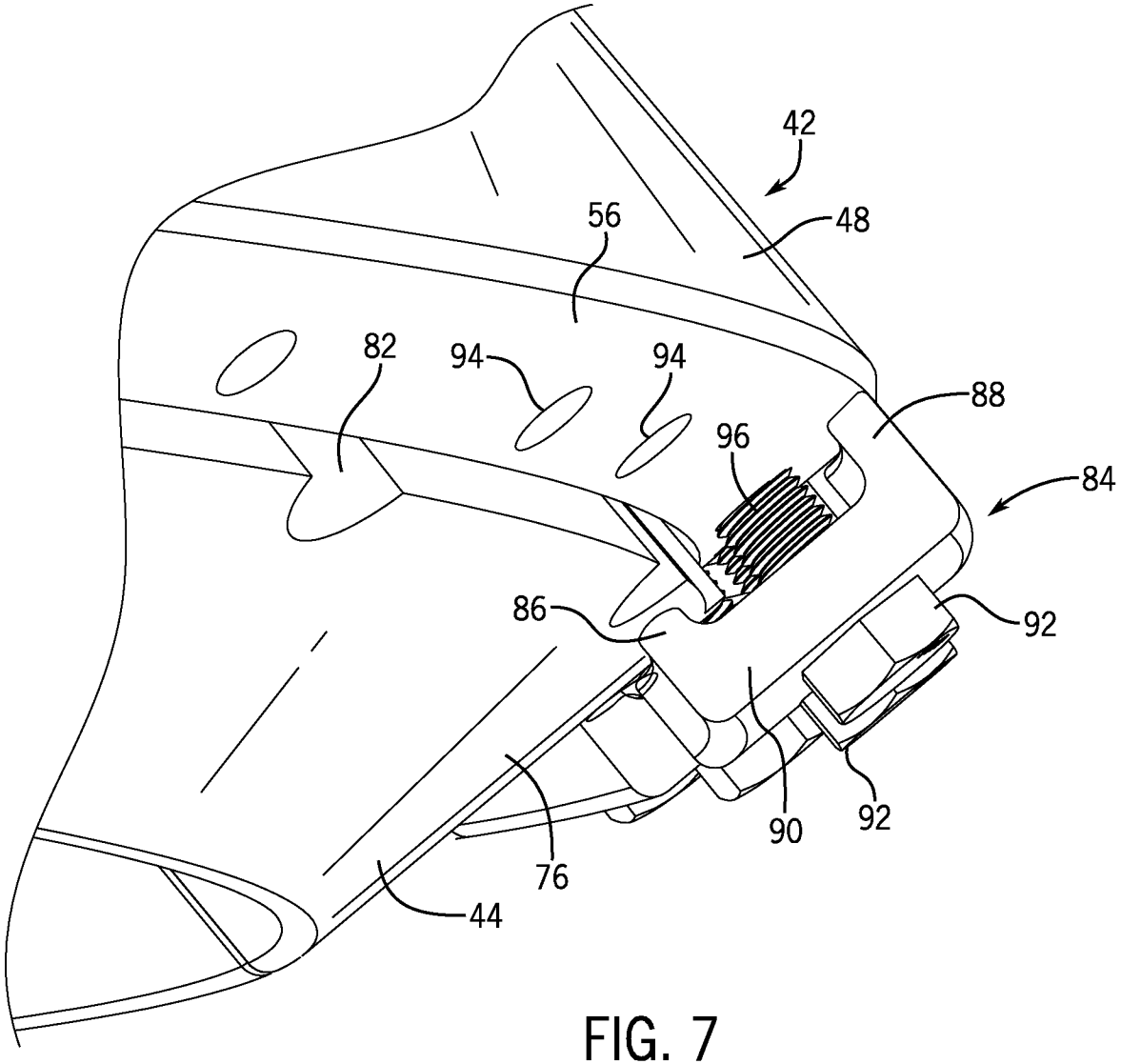
FIG. 7 is a magnified view showing the position of a support plate to hold the bowl liner section along the support cassette.

Referring now to FIGS. 3 and 7, the bowl liner 40 constructed in accordance with the exemplary embodiment of the present disclosure includes a plurality of support plates 84 that support each of the individual bowl liner sections 44 when installed on the support cassette 42 to prevent the bowl liner sections 44 from sliding out of the support cassette 42. In the embodiment shown in FIG. 3, three separate support plates 84 are associated with each of the bowl liner sections 44. However, it is contemplated that a fewer or greater number of support plates 84 could be associated with each of the individual bowl liner sections As illustrated in FIG. 7, each of the support plates 84 is a generally U-shaped member that includes an inner support leg 86 and an outer support leg 88 that are joined together by a connecting portion 90. Each of the support plates 84 includes a pair of connectors 92 that each extend through the connecting portion 90 and are received within an internally threaded bore 94 formed in the lower rim 56. In the embodiment shown in FIG. 7, each of the connectors 92 includes a threaded shaft 96 having external threads that mate with internal threads formed in each of the bores 94. In this manner, the connectors 92 can be used to secure the support plate 84 in the position shown in FIG. 7 while allowing the support plates to be removed when desired. In the installed position, the inner support leg 86 contacts the bottom surface 76 of the bowl liner section 44 while the outer support leg 88 contacts the lower rim 56.

When the plurality of bowl liner sections 44 are mounted to the support cassette, such as shown in FIGS. 3 and 7, the vertical channels 82 of each bowl liner section 44 are open to the exterior of the liner, as illustrated. The openings to the vertical channels 82 allow a supply of an epoxy material to be poured into the channel 82. Once the liquid epoxy material is poured into the open channel 82, the epoxy material flows into the joined vertical and horizontal channels and is allowed to harden such that the plurality of bowl liner sections 44 are secured to the inner surface of the support cassette.

Referring back to FIG. 5, when the bowl liner sections 44 are installed as shown, the top surface 78 is positioned against the retaining lip 66 and the support plates 84 exert pressure onto the bottom edge 76. In this manner, the combination of the epoxy that exists between the internal channels 61 formed along the inner surface 60 and the channels 82 formed along the mounting surface 70 of the bowl liner sections 44 hold the individual bowl liner sections 44 in place.

The bowl liner 40 shown in FIG. 2 has a multiple advantages over the one-piece bowl liner 26 shown in FIG. 1, including that the bowl liner 40 can be assembled at a remote location and shipped to a mine site where the cone crusher is operating for replacing a similar bowl liner. The assembly of the bowl liner 40 involves initially placing the support cassette 42 in an inverted position in which the attachment lip 46 rests upon a stable surface. When the support cassette 42 is in the inverted position, each of the individual bowl liner sections 44 are inserted such that the top edge 80 of the bowl liner section 44 comes into contact with the retaining lip 66. Once all of the bowl liner sections 44 have been installed, the plurality of support plates 84 are attached to the lower rim 56 utilizing the series of individual connectors 92. The installation of the plurality of support plates 82 holds each of the bowl liner sections 44 in place between the retaining lip 66 and the inner leg of the support plate.

Once all of the support plates 84 have been installed, a liquid epoxy material is poured into the open outer ends of the vertical channels 82 formed in the bowl liner sections 84. The liquid epoxy flows through the horizontal and vertical channels 82 and is allowed to harden. Once the epoxy has hardened, each of the bowl liner sections 44 are then held in place not only through the physical force created by the support plates 84 but also through the epoxy connection between the bowl liner sections and the support cassette. Once the epoxy has been allowed to harden, the bowl liner 40 can be installed into the cone crusher.

In one exemplary embodiment, when a bowl liner 40 is installed in the cone crusher and needs to be replaced, a second bowl liner is obtained and is present at a location near the cone crusher. The cone crusher 10 is then partially disassembled and the bowl liner 40 is removed. After the bowl liner is removed, the second bowl liner is positioned within the cone crusher and is installed as is well known. The first bowl liner that has been removed and replaced can then be disassembled by first removing each of the support plates 84. Once the support plates 84 are removed, a wedge or chisel can be used to release the epoxy between the bowl liner sections 44 and the support cassette. Once the first bowl liner section 44 is removed, the remaining bowl liner sections can be released from the epoxy connection and then discarded. Once all of the bowl liner sections 44 have been removed, new bowl liner sections can be installed in the manner as described previously.

Although the embodiment described above describes the use of a second bowl liner, it is contemplated that the bowl liner 40 could be removed and the bowl liner sections removed from the support cassette. New, replacement bowl liner sections would then be installed and the refurbished bowl liner would then be installed within the crusher. Such embodiment would eliminate the need for a second bowl liner.

In addition to the ability to reuse the support cassette 42, the bowl liner of the present disclosure allows different types of materials to be utilized to create the bowl liner sections 44 as compared to the single piece bowl liner 26 shown in FIG. 1. As described previously, the bowl liner section 26 shown in FIG. 1 is formed from an austenitic manganese steel which is a steel that hardens during working. In contrast, the bowl liner sections 44 of the present disclosure can be made from low alloy steel which is harder initially and does not expand as much during use. In this manner, the bowl liner sections 44 can be improved as compared to the material utilized in the single piece bowl liner shown in FIG. 1.

Although the present disclosure generally shows the use of a bowl liner with a cone crusher in an embodiment in which the bowl liner includes a single row of bowl liner sections 44, it is contemplated that the present disclosure could be used with other types of crushing equipment, such as a gyratory crusher. In such an embodiment, the support cassette would be constructed to support either a single row or multiple rows of wear pieces, such as concaves, which are similar in construction and operation to the bowl liner sections. In such a configuration, the concaves would be supported along an inner surface of a support cassette. The concaves would each be attached to the support cassette using an epoxy material and support plates. However, in an embodiment including multiple rows of concaves, each support plate in such an embodiment would support the multiple rows of concaves rather than the single layer of the bowl liner sections shown in the drawing figures. In the contemplated use of the support cassette and removable concaves, the combination of the support cassette and concaves would be removable as a single unit from the gyratory crusher for replacement, as described above with respect to the cone crusher. The individual concaves would be removed from the support cassette and new concaves installed for replacement into the gyratory crusher.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A bowl liner for use in a crusher, comprising:

a support cassette having a conical inner surface and a lower rim;

a plurality of bowl liner sections each having a mounting surface, a wear surface, a lower end and an upper end, wherein each of the bowl liner sections is supported on the inner surface of the support cassette; and a plurality of support plates positioned to retain the plurality of bowl liner sections along the support cassette, wherein each of the support plates include an inner support leg that contacts the bowl liner section and an outer support leg that contacts the lower rim of the cassette.

2. The bowl liner of claim 1 wherein each of the plurality of support plates are attached to the lower rim of the support cassette.

3. The bowl liner of claim 2 wherein each of the plurality of support plates are secured to the lower rim by one or more connectors such that the support plates can be selectively removed and attached to the lower rim.

4. The bowl liner of claim 1 wherein the support cassette is formed from steel.

5. The bowl liner of claim 1 wherein the plurality of bowl liner sections are adhered to the inner surface of the support cassette by an epoxy.

6. The bowl liner of claim 1 wherein a plurality of support plates are associated with each of the bowl liner sections.

7. The bowl liner of claim 1 wherein each of the support plates includes a connecting portion that joins the inner support leg to the outer support leg, wherein each of the support plates is secured to the lower rim by one or more connectors that passes through the connecting portion and is received within the lower rim such that the support plates can be selectively removed and attached to the lower rim.

8. A crusher for crushing rock, comprising:

a stationary bowl;

a head positioned within the stationary bowl and movable eccentrically relative to the stationary bowl; and a bowl liner detachably mounted to the stationary bowl, wherein the bowl liner comprises:

a support cassette having a conical inner surface and a lower rim;

a plurality of bowl liner sections each having a mounting surface, a wear surface, a lower end and an upper end, wherein each of the bowl liner sections is supported on the inner surface of the support cassette; and a plurality of support plates positioned to retain the plurality of bowl liner sections along the support cassette, wherein each of the support plates include and inner support leg that contacts the bowl liner section and an outer support leg that contacts the lower rim of the support cassette.

9. The crusher of claim 8 wherein each of the plurality of support plates are attached to the lower rim of the support cassette.

10. The crusher of claim 9 wherein each of the plurality of support plates are secured to the lower rim by one or more connectors such that each of the plurality of support plates can be selectively removed and attached to the lower rim.

11. The crusher of claim 8 wherein the support cassette is formed from steel.

12. The crusher of claim 8 wherein the plurality of bowl liner sections are adhered to the inner surface of the support cassette by an epoxy.

13. The crusher of claim 8 wherein each of the support plates includes a connecting portion that joins the inner support leg to the outer support leg, wherein each of the support plates is secured to the lower rim by one or more connectors that passes through the connecting portion and is received within the lower rim such that the support plates can be selectively removed and attached to the lower rim.

* * * * *